United States Patent [19]

Gilkey et al.

[11] 4,049,621

[45] Sept. 20, 1977

[54] TEXTILE FIBER

[75] Inventors: Russell Gilkey, Kingsport; Samuel D. Hilbert, Jonesboro; Thomas H. Wicker, Jr., Kingsport, all of Tenn.

[73] Assignee: Eastman Kodak Company, Rochester, N.Y.

[21] Appl. No.: 603,224

[22] Filed: Aug. 8, 1975

[51] Int. Cl.[2] ..... C08K 5/11; C08K 5/13; C08K 5/35

[52] U.S. Cl. ..... 260/40; 260/45.85 P; 260/45.95 H; 260/75 R

[58] Field of Search ..... 260/40 P, 45.85 P, 75 R, 260/45.95 H

[56] References Cited

U.S. PATENT DOCUMENTS

| | | | |
|---|---|---|---|
| 2,744,087 | 5/1956 | Snyder | 260/75 R |
| 3,002,942 | 10/1961 | Zoetbrood | 260/40 P X |
| 3,260,715 | 7/1966 | Saunders | 8/19 X |
| 3,520,846 | 7/1970 | England | 260/40 |
| 3,962,313 | 6/1976 | Dexter et al. | 260/45.85 P X |

FOREIGN PATENT DOCUMENTS

| | | |
|---|---|---|
| 387,565 | 2/1933 | United Kingdom |

*Primary Examiner*—Sandra M. Person

*Attorney, Agent, or Firm*—Charles R. Martin; Daniel B. Reece, III

[57] ABSTRACT

Disclosed is a polyester textile fiber comprised of an admixture of a polyetherester prepared from terephthalic acid, ethylene glycol and poly(oxyethylene) glycol, cobaltous aluminate, a whitening agent and a critical amount of a stabilizer. The textile fiber exhibits an unobvious Blue-Whiteness/Tenacity Retention Balance Value.

4 Claims, 2 Drawing Figures

TEXTILE FIBER

Figure 1:
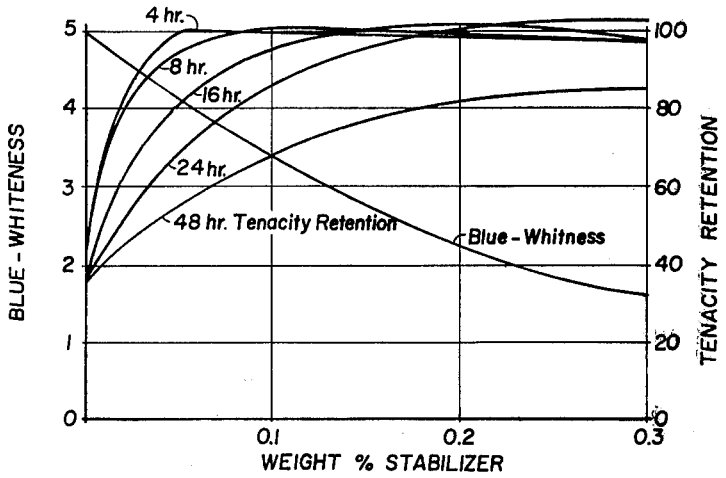

This invention relates to a textile fiber that exhibits an unobvious balance of blue-whiteness and tenacity retention.

The use of synthetic textile fibers has increased tremendously over the last several decades. The increased use of synthetic textile fibers has resulted to a large extent from the desirable combination of properties that can be achieved in a textile fabric by using blends of natural and synthetic fibers. The increased use of polyester fibers has resulted in large part from the excellent combination of properties of textile fabrics prepared from a blend of polyester and cotton staple fibers. Today, a wide variety of wearing apparel such as sleepwear, shirts and underwear, is prepared from a blend of polyester and cotton staple fibers.

Although a synthetic textile fiber may have any number of desirable properties, every textile fiber, including polyester fibers, must have a number of necessary properties to make the fiber commercially acceptable for typical applications, such as wearing apparel. Historically, the necessary properties include commercially acceptable whiteness and commercially acceptable tenacity retention.

Polyester fibers used in certain applications must have a certain degree of whiteness to be commercially acceptable because of two reasons. One reason is consumers prefer that white textile goods have no yellow cast. For example, a consumer purchasing a white shirt of a blend of polyester and cotton prefers that the shirt not have a yellow cast. Another reason a polyester fiber must have a certain degree of whiteness to be commercially acceptable is that dyeing a polyester fiber can be accomplished more effectively if the fiber has no yellow cast to begin with. Although the existence of a yellow cast can be overcome in dyeing many dark shades, it is expensive to correct for the existence of a yellow cast during dyeing and even if the correction is made, the correction can introduce a gray element into the final color. When the polyester fiber is to be used in a blend of polyester and cotton and prepared into typical textile goods, such as underwear, shirts, and the like, consumers tend to prefer that the textile goods have a blue cast. Thus, the whiteness preferred in many textile goods of polyester/cotton blends is a blue-whiteness. By the term "blue-whiteness", and words of similar import, we mean the substantial absence of any yellow color in the fiber and the existence of a slight blue color. In one aspect of this invention, polymer of the fiber has a *b* value of less than −4.0 when tested on a Gardner Color Meter.

A polyester fiber must have a certain degree of tenacity retention to be commercially acceptable because the fiber must have a minimum tensile strength in order to be processed into a textile fabric and to be acceptable in typical textile uses, such as wearing apparel. Obviously, if the loss in tenacity during the typical processing of the fiber from melt spinning to preparation of staple to yarn spinning to conversion into a typical woven textile fabric is too high, the fiber will not have enough strength to process further or to be used in wearing apparel. By the term "tenacity retention", and words of similar import, we mean the retention of tenacity of a polyester fiber when the fiber is carried through the various processing steps, such as heat setting, carding, spinning, weaving, bleaching and the like, that occur between melt spinning and the manufacture of the finished polyester or polyester-cotton fabric.

One undesirable property of previous polyester fibers was the difficulty of dyeing the polyester. Polyester is one of the few synthetic fibers that requires an additional quantity of energy to dye. When polyester fibers are dyed without use of a carrier in pressurized equipment the additional quantity of energy is in the form of high temperature. When polyester fibers are dyed with a carrier at atmospheric pressure at the boil, the additional quantity of energy is in the form of the chemical energy of the carrier and the energy necessary for removing residual carrier. The growing cost of energy has now caused polyester fibers to be regarded as less desirable because polyester fibers require additional energy to dye. Thus, in order to provide a more commercially desirable fiber, the properties that have been historically necessary for commercially acceptable polyester fibers must be revised to include dyeability without the additional quantity of energy that has been required in the past. Increasing the dyeability of a polyester by chemical modification of the polymer molecule reduces, and in some cases eliminates, the need for the extra amount of energy. If the polyester is to be dyed in pressure equipment, the enhanced dyeability of the polyester reduces the temperature and/or time that is needed and consequently creates a reduction in the additional amount of heat energy. When the polyester fiber is dyed at atmospheric pressure at the boil, the absence of the need for a carrier eliminates the chemical energy of the carrier and the energy required for carrier removal.

Efforts to produce a polyester fiber which will dye without a carrier, and thus reduce or eliminate the additional energy required to dye the polyester, have generally been unsatisfactory. The failure to produce a polyester fiber has not generally resulted from an inability to prepare a fiber that is dyeable without a carrier, but has instead resulted from an inability of the fiber to be dyeable without a carrier and still retain the properties necessary for commercial acceptability, including whiteness and tenacity retention. For example, it is disclosed in U.S. Pat. No. 2,744,087 that a staple polyetherester fiber for use in polyester/cotton blends can be prepared from terephthalic acid, ethylene glycol and poly(oxyethylene)glycol to create a fiber dyeable without a carrier, but this fiber has commercially unacceptable blue-whiteness and commercially unacceptable tenacity retention.

Efforts to achieve commercially acceptable blue-whiteness and commercially acceptable tenacity retention in this type of fiber have been far from successful. The problem in achieving a combination of commercially acceptable blue-whiteness and commercially acceptable tenacity retention is a particularly difficult problem because an improvement in blue-whiteness often results in a reduction in tenacity retention and an improvement in tenacity retention often causes a reduction in blue-whiteness. For example, introduction of an oxidation stabilizer into the fiber increases the tenacity retention but decreases the blue-whiteness of the fiber. Thus, even when a whitening agent is used to produce increased blue-whiteness, a compromise in the amount of stabilizer that can be used is required. The textile fiber must have enough stabilizer to provide commercially acceptable tenacity retention but must not have so much stabilizer that the blue-whiteness is unacceptable, even when a whitening agent is used.

We have now invented a polyetherester fiber dyeable without a carrier that has commercially acceptable blue-whiteness and tenacity retention. The commercially acceptable blue-whiteness and tenacity retention results from a balance of blue-whiteness and tenacity retention achieved through use of a critical amount of a stabilizer. The balance of blue-whiteness and tenacity retention of the textile fiber of this invention can be described as the "Blue-Whiteness/Tenacity Retention Balance Value".

The textile fiber of this invention is thought to be unobvious because the use of a critical amount of stabilizer produces a Blue-Whiteness/Tenacity Retention Balance Value that is unobvious over the Blue-Whiteness/Tenacity Retention Balance Value that would be expected in view of the prior art.

In this disclosure, the term "Blue-Whiteness/-Tenacity Retention Balance Value", and words of similar import, means the value of the sum of the values of blue-whiteness and tenacity retention. The value of blue-whiteness is determined on the International Geometric Gray Scale after a bleaching or gas fading test. On the International Geometric Gray Scale a rating of 1 is the worst and 5 is the best, or no change from a control fabric. The bleach test is conducted by determining the resistance of the fiber to color development in AATCC Test Method 101-1972, entitled "Color Fastness to Bleaching with Peroxide", Test No. 3. The gas fading test is conducted by determining the color change in AATCC Test Method 23-1972 entitled "Color Fastness to Burnt Gas Fumes". The value of tenacity retention is determined after exposure of the heat set fiber in an air oven at 160° C. The value of tenacity retention is the percentage of the original tenacity. Thus, this test measures the reduction in tenacity in terms of time and temperature.

Since the Blue-Whiteness/Tenacity Retention Balance Value is the sum of the values of blue-whiteness and tenacity retention, it is important to consider the manner in which the blue-whiteness and tenacity retention vary individually with time and the amount of stabilizer used. Several quantitative expressions of the variation of the blue-whiteness and the variation of the tenacity retention are presented in graphical form in FIG. 1.

In FIG. 1 the blue-whiteness value is plotted on the left ordinate, the tenacity retention value is plotted on the right ordinate and the quantity of stabilizer is plotted on the abscissa. There is plotted one curve of the variation in blue-whiteness with the amount of stabilizer used over the period 0 to 48 hours. Since only one curve is presented it will be understood the relationship between blue-whiteness and amount of stabilizer used does not vary over this period of time and the blue-whiteness varies only with the amount of stabilizer used. Also in FIG. 1 there is presented a family of curves for the time variation in tenacity retention with changes in the amount of stabilizer used. Curves for 4, 8, 16, 24 and 48 hours are presented. As will be understood by those skilled in the art, the family of curves means the tenacity retention changes with time and with the amount of stabilizer used. The data used to prepare the curves illustrated in FIG. 1 are developed by preparing a textile fiber of the invention and measuring the blue-whiteness and tenacity retention as disclosed above.

Since, as described earlier, the problem is obtaining a commercially acceptable balance of blue-whiteness and tenacity retention, or a commercially acceptable Blue-Whiteness/Tenacity Retention Balance Value, the sum of the blue-whiteness and the tenacity retention is quite important. The sum of the blue-whiteness and the tenacity retention, expressed as the Blue-Whiteness/Tenacity Retention Balance Value, is presented in FIG. 2.

Figure 2:
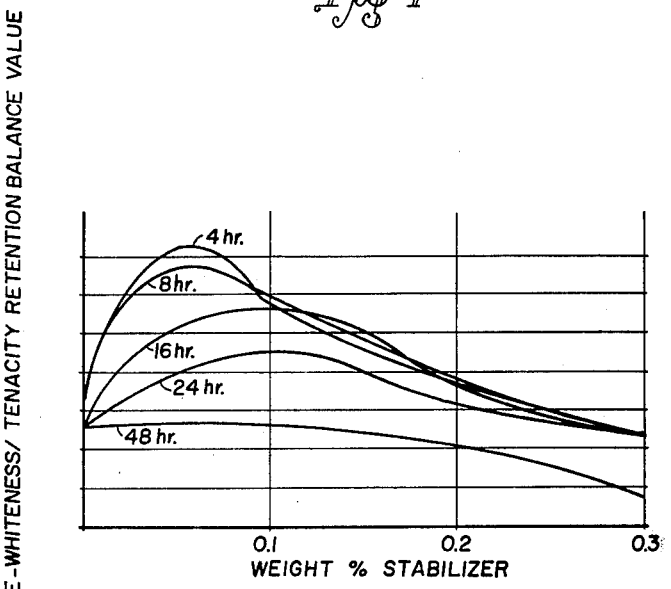

In FIG. 2 there is plotted on the ordinate the Blue-Whiteness/Tenacity Retention Balance Value, which is the sum of the values of the blue-whiteness and the tenacity retention for the curves presented in FIG. 1. On the abscissa there is plotted the amount of stabilizer used. As can be observed from a consideration of the family of curves representing the Blue-Whiteness/-Tenacity Retention Balance Value, the Blue-Whiteness/Tenacity Retention Balance Value for the 4, 8 and 16 hour curves starts at a low value for low amounts of stabilizer present, increases with increasing amounts of stabilizer, and then begins to decrease with increasing amounts of stabilizer used. Specifically, the Blue-Whiteness/Tenacity Retention Balance Value is at least about 75 when the range of stabilizer is 0.01 to 0.16 weight percent, based on the weight of the polyetherester. Additionally, when the range of stabilizer is 0.02 to 0.13 weight percent, based on the weight of the polyetherester, the Blue-Whiteness/Tenacity Retention Balance Value is at least about 80 for the 4, 8 and 16 hour curves.

The curves of FIG. 2 illustrate that within the range of 0.01 to 0.16 weight percent stabilizer, the Blue-Whiteness/Tenacity Retention Balance Value is indeed critical. If less than 0.01, or more than 0.16 weight percent stabilizer is used, the Blue-Whiteness/Tenacity Retention Balance Value is unacceptably low. Only in the critical range of 0.01 to 0.16 weight percent stabilizer is the Blue-Whiteness/Tenacity Retention Balance Value acceptable.

There are two embodiments to the textile fiber of this invention. In the first embodiment the textile fiber contains either a first whitening agent or a second whitening agent. In the second embodiment, the textile fiber contains both the first whitening agent and the second whitening agent. The use of both whitening agents produces a fiber with less gray portion in the color.

In the first embodiment of this invention the textile fiber is broadly comprised of an admixture of A. a polyetherester of
1. terephthalic acid, and
2. a diol component comprised of
   a. ethylene glycol, and
   b. from 6 to 12 weight percent, based on the weight of the polyetherester, of poly(oxyethylene)glycol having a molecular weight in the range of 200–600, B. from 50 to 200 weight parts per million, based on the weight of the polyetherester, cobaltous aluminate, C. from 0.01 to 0.16 weight percent, based on the weight of the polyetherester, of a stabilizer, D. a whitening agent which is
1. from 0.5 to 4.0 weight parts per million, based on the weight of the polyetherester, of a thermally stable, organic compound characterized by having a high reflectance in the range of 400 to 500 nm and strong absorbance in the range of 550 to 650 nm, or
2. from 100 to 400 weight parts per million, based on the weight of the polyetherester, of a thermally stable, organic compound having a fluorescence emission spectrum in methylene chloride in the range of 425 to 445 nm.

The textile fiber of the second embodiment of this invention is broadly comprised of an admixture of

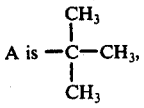

A. a polyetherester of
1. terephthalic acid, and
2. a diol component comprised of
   a. ethylene glycol, and
   b. from 6 to 12 weight percent, based on the weight of the polyetherester, of poly(oxyethylene)glycol having a molecular weight in the range of 200–600, B. from 50 to 200 weight parts per million, based on the weight of the polyetherester, cobaltous aluminate, C. from 0.01 to 0.16 weight percent, based on the weight of the polyetherester, of a stabilizer, D. a whitening agent which is from 0.5 to 4.0 weight parts per million, based on the weight of the polyetherester, of a thermally stable, organic compound characterized by having a high reflectance in the range of 400 to 500 nm and a strong absorbance in the range of 550 to 650 nm, and E. a whitening agent which is from 100 to 400 weight parts per million, based on the weight of the polyetherester, of a thermally stable, organic compound having a fluorescence emission spectrum in methylene chloride in the range of 425 to 445 nm.

In this invention the polyetherester is formed from terephthalic acid and a diol component comprised of ethylene glycol and poly(oxyethylene)glycol. The amount of poly(oxyethylene)glycol is broadly from 6 to 12 weight percent, based on the weight of the polyetherester. If less than 6 weight percent poly(oxyethylene)glycol is used, the fiber tends to not exhibit acceptable dyeability wituout a carrier. If more than about 12 weight percent poly(oxyethylene)glycol is used, the overall balance of properties of the fiber tends to become unacceptable. In a preferred embodiment, the amount of poly(oxyethylene)glycol is from 8 to 10 percent. The molecular weight of the poly(oxyethylene)glycol is in the range of 200 to 600, preferably from 300 to 500, calculated as average molecular weight in accordance with procedures for molecular weight determination by end group analysis and ebullimetry. If the molecular weight of the poly(oxyethylene)glycol is above about 600 the textile fiber of this invention exhibits commercially unacceptable lightfastness. If the molecular weight of the poly(oxyethylene)glycol is below about 200 the textile fiber of this invention will not have commercially acceptable fiber properties, especially heat resistant related properties, due to the lower melting point of the polymer.

As will be recognized by those skilled in the art, the moles of diol components must be substantially the same as the moles of terephthalic acid component in the final polyetherester or the molecular weight of the polyetherester will not be high enough to form the claimed textile fiber.

This invention has been described in terms of the acid form of terephthalic acid but the term "terephthalic acid", and words of similar import, is intended to include esters of terephthalic acid, such as dimethyl terephthalate.

The polyetherester of this invention has an inherent viscosity of at least 0.4, and preferably at least 0.50, measured at 25° C. using 0.5 grams of polymer per 100 ml. of a solvent composed of 60 volumes of phenol and 40 volumes of tetrachloroethane.

The cobaltous aluminate that can be used in this invention has been well known in the art for many years as an additive for polyesters and is disclosed in British Pat. Nos. 847,959, 979,666, and 934,095, as well as U.S. Pat. No. 3,520,846. The amounts of cobaltous aluminate can be from 50 to 200 weight parts per million, preferably 75 to 150 weight parts per million, based on the weight of the polyetherester.

As disclosed previously in detail, a critical amount of a stabilizer is used to provide an unobvious Blue-Whiteness/Tenacity Retention Balance Value. Broadly the stabilizer useful in this invention can be described as a relatively nonvolatile hindered phenolic antioxidant corresponding to the structure.

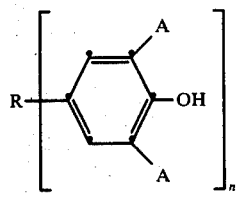

where

*n* is from 1 to 4,

R is a radical selected from the group consisting of
1. neopentanetetrayltetrakis[oxy(3-oxotrimethylene)],
2. phosphinylidynetrioxy,
3. 2,4,6-trimethyl-1,3,5-benzenetriyltrimethylene,
4. alkylene having 1 to 5 carbon atoms,
5. alkyl having 1 to 12 carbon atoms, and
6. 2,4,6-trioxo-1,2,3,4,5,6-hexahydro-s-triazine-1,3,5-triyl)tris(3-oxotrimethylene), and
7. [3-octadecyloxy)-3-oxopropyl].

A is a monovalent radical selected from the group consisting of
1. tertiary alkyl having 4 to 8 carbon atoms,
2. alkyl having 8 to 22 carbon atoms, and
3. secondary alkyl having 12 to 24 carbon atoms.

Examples of alkylene radicals having 1 to 5 carbon atoms include $-CH_2-$, $-CH_2CH_2-$;

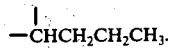

Examples of alkyl radicals having 1 to 12 carbon atoms include $CH_3-$, $C_2H_5-$, $C_3H_7-$, $C_6H_{13}-$, $C_9H_{19}-$, and $C_{12}H_{25}-$.

Examples of monovalent tertiary alkyl radicals having 4 to 8 carbon atoms include $-C(CH_3)_3$, $-C(C_2H_5)(CH_3)_2$,

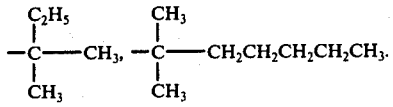

Examples of monovalent alkyl radicals having 8 to 22 carbon atoms include

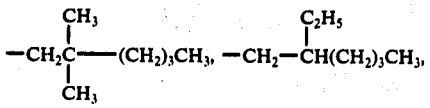

$-CH_2(CH_2)_6CH_3$, $-CH_2(CH_2)_{10}CH_3$, and $-C_{18}H_{37}$.

Examples of monovalent secondary alkyl radicals having 12 to 24 carbon atoms include

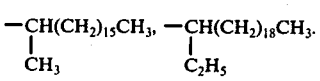

A preferred antioxidant is pentaerythritol tetrakis[3-(3,5-di-tert-butyl)-4-hydroxyphenyl]propionate which is sold commercially as Irganox 1010 by Geigy Chemical Company and corresponds to the structure

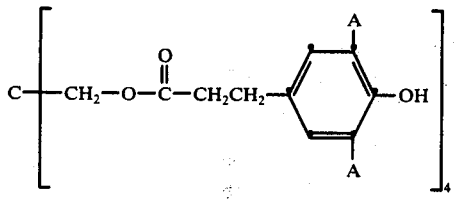

where

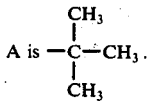

Among the other hindered phenols which are useful in our invention are 4,4'-butylidenebis(6-tert-butyl-m-cresol), 1,3,5-trimethyl-2,4,6-tris(3,5-di-tert-butyl-4-hydroxybenzyl)benzene, tris(3,5-di-tert-butyl)4-hydroxyphenyl phosphate, and dioctadecyl 3,5-di-tert-butyl-4-hydroxybenzyl phosphonate.

The amount of stabilizer can be from 0.01 to 0.16 weight percent, preferably 0.02 to 0.13 weight percent, based on the weight of the polyetherester.

The first whitening agent useful in this invention is a thermally stable, organic compound characterized by having a high reflectance in the range of 400 to 500 nm and strong absorbance in the range of 550 to 650 nm. Compounds of this nature are well known in the art and are described in "Color Index", The Society of Dryers and Colorists, 3rd Edition (1971). Examples of compounds are Indanthrene Brilliant Violet 3B (C.I. 60,005), Platinum Violet (C.I. 60,010), and Isoviolanthrone (C.I. 60,000).

In a preferred embodiment of the whitening agent corresponds to the structure

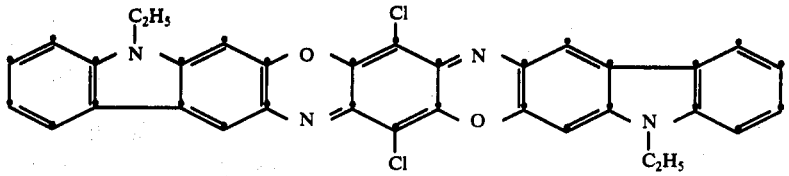

This compound is well known in the art and is often called C.I. Pigment Violet 23 and is described in British Pat. No. 387,565.

The amount of the first whitening agent that can be used in this invention is from 0.5 to 4.0 weight parts per million, preferably 1.0 to 2.5 weight parts per million, based on the weight of the polyetherester.

The second whitening agent that can be used in this invention is a thermally stable, organic compound having a fluoroescence emission spectrum in methylene chloride in the range of 425 to 445 nm. Compounds of this nature are well known in the art and are disclosed in "Encyclopedia of Polymer Science and Technology", (John Wiley & Sons, Inc., 1965) Volume 2, p. 606–613 and in A. K. Sakar, "Fluorescent Whiting Agents", Morrow Publishing Co., Ltd., England (1971). Examples of compounds are 2,2'-(vinylenedi-p-phenylene)bis(4,6-diphenyl-5-triazine) sold as Uvitex MES, 2,2'-(2,5-thiophenediyl)bis-[5-(α,α-dimethylbenzyl)benzoxazole] sold as Uvitex 1980, 2,2'-vinylenedi-p-phenylenebisbenzoxazole sold as Eastman[scr] OB-1, and 7-(2H-naphtho[1,2-d]triazol-2-yl)-3-phenylcoumarin sold as Leucopure EGM.

In a preferred embodiment the second whitening agent corresponds to the structure

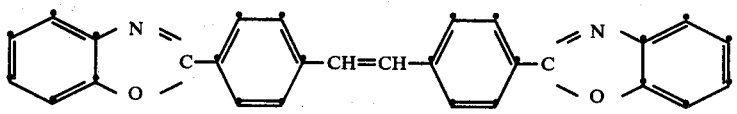

This compound is well known in the art and is disclosed in U.S. Pat. No. 3,260,715. The amount of the second whitening agent is 100 to 400 weight parts per million, preferably 150 to 300 weight parts per million, based on the weight of the polyetherester.

In both the first and second embodiments from 0.1 to 0.4 weight percent, based on the weight of the polyetherester, of $TiO_2$ particles having a size of less than 5 microns can be used.

The textile fiber of this invention can be prepared according to methods well known in the art.

According to one method of preparing the textile fiber of the second embodiment of the invention wherein two whitening agents are used, a mixture of the first whitening agent and a polyetherester prepolymer is formed by ester interchanging dimethyl terephthalate, ethylene glycol and poly(oxyethylene)glycol in the presence of the first whitening agent. As will be recognized by those skilled in the art, methanol is eliminated during formation of an oligomeric product and there is formed a hydroxy terminated low molecular weight polymer having a degree of polymerization of 4 to 8.

The ester interchange reaction can be conducted in the presence of a suitable catalyst, such as zinc acetate.

The thermodynamic conditions used in ester interchange can vary depending on the particular desires of the practitioner of the invention. Thus, one skilled in the art could select a wide variety of pressure and temperature conditions suitable to form the ester interchange product. One example of thermodynamic conditions that can be used is a pressure in the range of 20 to 50 psig and a temperature of 180° to 240° C.

The next step in practicing this invention involves adding cobaltous aluminate, the second whitening agent, the titanium dioxide and optionally a conventional phosphorus stabilizer, to the admixture of the ester interchange product and the first whitening agent. These materials can be slurried in ethylene glycol and the slurry added to the admixture of the first whitening agent and the ester interchange product.

The next step in practicing this invention involves forming a final polyetherester, having an inherent viscosity of at least 0.4, from the ester interchange product using a suitable catalyst, such as antimony acetate. This step, often called polycondensation by those skilled in the art, can be accomplished in conventional equipment well known in the art. The thermodynamic conditions used to form the final polyetherester can vary widely depending on the desires of the practitioner of the invention. According to one manner in which the invention can be practiced, the high molecular weight polyetherester is formed at a pressure within the range of 0.1 to 100 mm. Hg. and a temperature within the range of 260° to 290° C. by the elimination of ethylene glycol. Preferably the inherent viscosity of the final polyetherester is at least 0.50.

The next step in practicing the invention involves admixing with the admixture of the cobaltous aluminate, first whitening agent, second whitening agnet, titanium dioxide, phosphorus stabilizer, and final polyetherester, based on the weight of the polyetherester, from 0.01 to 0.16 weight percent, preferably 0.02 to 0.13 weight percent, of the stabilizer which provides an unobvious Blue-Whiteness/Tenacity Retention Balance Value. The admixture of the various materials and the final polyetherester can be admixed with the stabilizer according to techniques well known in the art, such as application from a volatile solvent onto extruded pellets, mixing the polymer with a small quantity of a second polymer containing a relatively large amount of stabilizer or, preferably, through melt blending by use of an in-line mixer.

The next step in practicing the invention involves melt spinning the admixture of the final polyetherester, cobaltous aluminate, first whitening agent, second whitening agent, titanium dioxide, phosphorus stabilizer, and the stabilizer into fibers in accordance with techniques well known in the art. According to one method of practicing the invention, melt spinning is conducted at a temperature of about 280° C. and a pressure of about 600 psi.

The next step in practicing this invention involves drafting the fibers according to techniques well known in the art. A draft ratio of 1:3.0–5.0 can be used. If desired, the drafting can be accomplished in two stages in water and steam in accordance with conventional technology.

The remaining steps in practicing this invention involve conventional steps such as heat setting, cutting into staple fiber and the like.

The textile fiber of the first embodiment of the invention, wherein only one whitening agent is used, can be prepared in a similar manner as the textile fiber of the second embodiment of the invention, wherein two whitening agents are used, except of course one of the whitening agents would be omitted when preparing the textile fiber of the first embodiment of the invention.

Although the invention has been described in considerable detail with particular reference to certain preferred embodiments thereof, variations and modifications can be effected within the spirit and scope of the invention.

We claim:

1. A textile fiber comprised of an admixture of

A. a polyetherester of
   1. terephthalic acid, and
   2. a diol component comprised of
      a. ethylene glycol, and
      b. from 6 to 12 weight percent, based on the weight of the polyester, of poly(oxyethylene)-glycol having a molecular weight in the range of 200–600, B. from 50 to 200 weight parts per million, based on the weight of the polyetherester, cobaltous aluminate, C. from 0.01 to 0.16 weight percent, based on the weight of the polyetherester, of a stabilizer effective to reduce oxidative degradation of the polyester corresponding to the structure

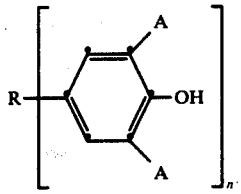

$n$ is from 1 to 4,

R is a radical selected from the group consisting of
   1. neopentanetetrayltetrakis[oxy(3-oxotrimethylene)],
   2. phosphinylidynetrioxy,
   3. 2,4,6-trimethyl-1,3,5-benzenetriyltrimethylene,
   4. alkylene having 1 to 5 carbon atoms,
   5. alkyl having 1 to 12 carbon atoms,
   6. (2,4,6-trioxo-1,2,3,4,5,6-hexahydro-s-triazine-1,3,5-triyl)tris(3-oxotrimethylene),
   7. [3-octadecyloxy)-3-oxopropyl], and A is a monovalent radical selected from the group consisting of
   1. tertiary alkyl having 4 to 8 carbon atoms,
   2. alkyl having 8 to 22 carbon atoms, and
   3. secondary alkyl having 12 to 24 carbon atoms, and D. a whitening agent which is
   1. from 0.5 to 4.0 weight parts per million, based on the weight of the polyetherester, of a thermally stable, organic compound characterized by having a high reflectance in the range of 400 to 500 nm and strong absorbance in the range of 550 to 650 nm, or
   2. from 100 to 400 weight parts per million, based on the weight of the polyetherester, of a thermally stable, organic compound having a fluorescence emission spectrum in methylene chloride in the range of 425 to 445 nm.

2. A textile fiber comprised of
A. a polyetherester of
1. terephthalic acid, and
2. a diol component comprised of
a. ethylene glycol, and
b. from 8 to 10 weight percent, based on the weight of the polyester, of poly(oxyethylene)-glycol having a molecular weight in the range of 300–500,
B. from 75 to 150 weight parts per million, based on the weight of the polyetherester, cobaltous aluminate,
C. from 0.02 to 0.13 weight percent, based on the weight of the polyetherester, pentaerythritol tetrakis[3-(3,5-di-tert-butyl-4-hydroxyphenyl)propionate] having the structure

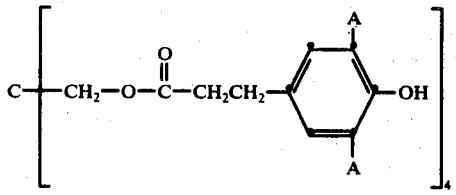

where

A is $-\underset{CH_3}{\overset{CH_3}{C}}-CH_3$, and

D. a whitening agent which is
1. from 1.0 to 2.5 weight per million, based on the weight of the polyetherester, of a thermally stable, organic compound corresponding to the structure

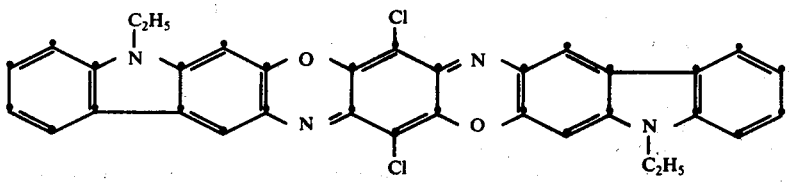

or
2. from 150 to 300 weight parts per million, based on the weight of the polyetherester, of a thermally stable, organic compound corresponding to the structure

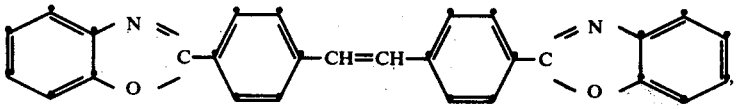

and
E. from 0.1 to 0.4 weight percent, based on the weight of the polyetherester, of $TiO_2$ particles having a size of less than 5 microns.

3. A textile fiber comprised of an admixture of
A. a polyetherester of
1. terephthalic acid, and
2. a diol component comprised of
a. ethylene glycol, and
b. from 6 to 12 weight percent, based on the weight of the polyester, of poly(oxyethylene)-glycol having a molecular weight in the range of 200–600,
B. from 50 to 200 weight parts per million, based on the weight of the polyetherester, cobaltous aluminate,
C. from 0.01 to 0.16 weight percent, based on the weight of the polyetherester, of a stabilizer effective to reduce oxidative degradation of the polyester corresponding to the structure

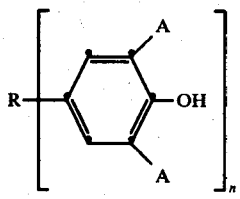

where
$n$ is from 1 to 4,
R is a radical selected from the group consisting of
1. neopentanetetrayltetraskis[oxy(3-oxotrimethylene)],
2. phosphinylidynetrioxy,
3. 2,4,6-trimethyl-1,3,5-benzenetriyltrimethylene,
4. alkylene having 1 to 5 carbon atoms,
5. alkyl having 1 to 12 carbon atoms, and
6. (2,4,6-trioxo-1,2,3,4,5,6-hexahydro-s-triazine-1,3,5-triyl)tris(3-oxotrimethylene),
7. [3-octadecyloxy)-3-oxopropyl], and
A is a monovalent radical selected from the group consisting of
1. tertiary alkyl having 4 to 8 carbon atoms,
2. alkyl having 8 to 22 carbon atoms, and
3. secondary alkyl having 12 to 24 carbon atoms, and
D. a whitening agent which is from 0.5 to 4.0 weight parts per million, based on the weight of the polyetherester, of a thermally stable, organic compound characterized by having a high reflectance in the range of 400 to 500 nm and strong absorbance in the range of 550 to 650 nm, and
E. a whitening agent which is from 100 to 400 weight parts per million, based on the weight of the polyetherester, of a thermally stable, organic compound having a fluorescence emission spectrum in methylene chloride in the range of 425 to 445 nm.

4. A textile fiber comprised of
A. a polyetherester of
1. terephthalic acid, and
2. a diol component comprised of
a. ethylene glycol, and
b. from 8 to 10 weight percent, based on the weight of the polyester, of poly(oxyethylene)- glycol having a molecular weight in the range of 300–500,

B. from 75 to 125 weight parts per million, based on the weight of the polyetherester, cobaltous aluminate, C. from 0.02 to 0.13 weight percent, based on the weight of the polyetherester, pentaerythritol tetrakis[3-(3,5-di-tert-butyl-4-hydroxyphenyl)propionate] having the structure

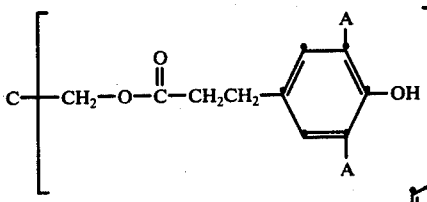

where

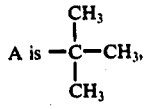

and

D. a whitening agent which is from 1.0 to 2.5 weight parts per million, based on the weight of the polyetherester, of a thermally stable, organic compound corresponding to the structure

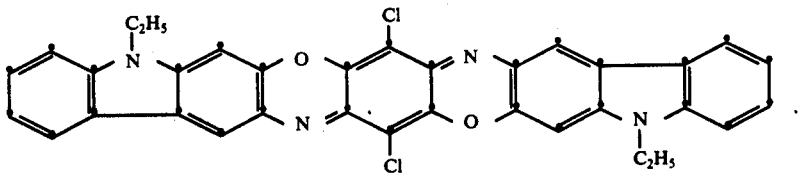

E. a whitening agent which is from 150 to 300 weight parts per million, based on the weight of the polyetherester, of a thermally stable, organic compound corresponding to the structure

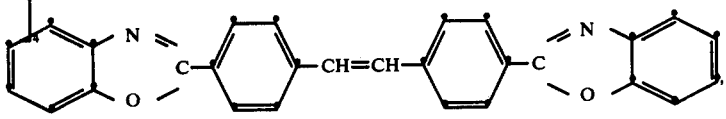

and

F. from 0.1 to 4.0 weight percent, based on the weight of the polyetherester, of $TiO_2$ particles having a size of less than 5 microns.

* * * * *